US010813406B2

(12) United States Patent
Giandolini et al.

(10) Patent No.: US 10,813,406 B2
(45) Date of Patent: Oct. 27, 2020

(54) FOOTWEAR WITH IMPROVED SOLE ASSEMBLY

(71) Applicant: SALOMON S.A.S., Metz-Tessy (FR)

(72) Inventors: Marlène Giandolini, Thorens-Glières (FR); René Borel, Saint-Sylvestre (FR); Simon Bartold, Veyrier du Lac (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 78 days.

(21) Appl. No.: 15/951,872

(22) Filed: Apr. 12, 2018

(65) Prior Publication Data

US 2018/0295935 A1 Oct. 18, 2018

(30) Foreign Application Priority Data

Apr. 13, 2017 (FR) ..... 17 00408

(51) Int. Cl.
*A43B 13/14* (2006.01)
*A43B 13/18* (2006.01)

(52) U.S. Cl.
CPC ..... *A43B 13/141* (2013.01); *A43B 13/181* (2013.01)

(58) Field of Classification Search
CPC ..... A41B 13/141; A41B 13/14; A41B 13/181; A41B 1/10
See application file for complete search history.

(56) References Cited

U.S. PATENT DOCUMENTS

| | | | | | |
|---|---|---|---|---|---|
| 4,551,930 | A * | 11/1985 | Graham | A43B 5/06 36/114 |
| D330,454 | S * | 10/1992 | Elliot | D2/955 |
| D459,063 | S * | 6/2002 | Nason | D2/953 |
| D536,517 | S * | 2/2007 | Gerber | D2/953 |
| 7,946,058 | B2 * | 5/2011 | Johnson | A43B 3/0057 36/102 |
| 8,656,613 | B2 * | 2/2014 | Stockbridge | A43B 13/00 36/102 |
| 9,717,304 | B2 * | 8/2017 | Bernhard | A43B 13/125 |
| D825,165 | S * | 8/2018 | Gibson | D2/960 |
| 10,470,521 | B2 * | 11/2019 | Iuchi | A43B 13/127 |
| 2014/0013624 | A1 * | 1/2014 | Stockbridge | A43B 13/00 36/103 |

(Continued)

FOREIGN PATENT DOCUMENTS

EP 1 787 540 5/2007

*Primary Examiner* — Shaun R Hurley
*Assistant Examiner* — Bao-Thieu L Nguyen
(74) *Attorney, Agent, or Firm* — Greenblum & Bernstein, P.L.C.

(57) ABSTRACT

A flexible shoe including an outer sole assembly and an upper, the outer sole assembly including a damping sole extending lengthwise from a rear end to a front end, widthwise between a lateral side and a medial side, and heightwise from a lower surface to an upper surface, the lower surface having lower grooves, the upper surface having upper grooves, the lower grooves of the lower surface being opposite the upper grooves of the upper surface. The lower grooves of the lower surface and the upper grooves of the upper surface correspond to the main articulations of the foot. The lower grooves of the lower surface and the upper grooves of the upper surface demarcate platforms of the damping sole.

20 Claims, 4 Drawing Sheets

(56) References Cited

U.S. PATENT DOCUMENTS

| | | | | |
|---|---|---|---|---|
| 2014/0041261 | A1* | 2/2014 | Walker | A43B 13/18<br>36/25 R |
| 2017/0280822 | A1* | 10/2017 | Langvin | A43B 3/26 |
| 2018/0199666 | A1* | 7/2018 | Moriyasu | A43B 13/16 |
| 2018/0263335 | A1* | 9/2018 | Iuchi | A43B 13/186 |
| 2018/0368517 | A1* | 12/2018 | Lilley | A43B 3/0042 |
| 2019/0281920 | A1* | 9/2019 | Ito | A43B 13/141 |

* cited by examiner

FOOTWEAR WITH IMPROVED SOLE ASSEMBLY

CROSS-REFERENCE TO RELATED APPLICATION

This application is based upon French Patent Application No. FR 17/00408, filed Apr. 13, 2017, the disclosure of which is hereby incorporated by reference thereto in its entirety, and the priority of which is claimed under 35 U.S.C. § 119.

BACKGROUND

1. Field of the Invention

The invention relates to an article of footwear, such as a shoe, intended for various purposes, including urban use and sports. A shoe according to the invention can be used for activities such as walking, running on flat or mountainous terrain, skateboarding, ball sports, cross-country or telemark skiing, snowboarding, snowshoeing, or the like.

2. Background Information

For the intended uses, the shoe must have a good damping capability and a certain flexibility. Damping is intended to reduce or even prevent fatigue or injuries that may result from supports or impacts on the ground, or from various stresses. Flexibility must be understood as an ability to adjust to certain deformations of the foot of a user, to relative movements of the foot and of the lower leg, or the like, during a walking or running cycle. This is intended notably to enable good rolling motion of the foot when walking or running; and it is known for this purpose to manufacture a shoe that is flexible in the area of its sole assembly.

For example, according to U.S. Pat. No. 8,656,613, the outer sole assembly of a flexible shoe comprises a damping sole comprised of a fairly significant number of small platforms connected to one another by connecting elements. This structure makes the damping sole very flexible in transverse bending, along a longitudinal axis, and also very flexible in longitudinal bending, along a transverse axis. As a result, the damping sole flexes easily to follow the rolling motion of the foot during a walking cycle, in order to respect the natural motion of the foot as much as possible.

A shoe according to U.S. Pat. No. 8,656,613 yields real advantages, whereby the damping sole featured therein indeed makes it easier to walk or run. However, this sole nevertheless has a number of disadvantages, one of which, for example, is a certain lack of stability in ground support, especially on rough terrain. Another disadvantage is an incomplete or even distorted transmission of sensory information between the ground and the foot, especially during intense sporting activities or extreme use scenarios. This is mainly because the various platforms are randomly distributed and do not properly follow the main articulations of a foot, that is to say, they are not in correlation with the anatomy. As a result, the user does not always accurately or faithfully perceive the supports, the impacts and, more generally, the various stresses that occur in the area of the sole assembly. Other disadvantages observed include additional fatigue, and therefore a decrease in athletic performance, or an increased risk of injuries, such as joint trauma in the area of the foot, and even in the area of the knee.

SUMMARY

In view of the preceding, the invention generally provides an improved shoe. More particularly, the invention provides more stability in the ground supports, whether on level or uneven terrain. The invention further enables the damping sole of a flexible shoe to transmit all or almost all sensory information between the ground and the foot with fidelity, to reduce user fatigue and to increase the athletic performance of the user, and to reduce the risk of injuries.

To this end, the invention provides a flexible shoe comprising an outer sole assembly and an upper, the outer sole assembly comprising a damping sole, the damping sole extending lengthwise from a rear end to a front end, widthwise between a lateral side and a medial side, and heightwise from a lower surface to an upper surface, the lower surface having lower grooves, the upper surface having upper grooves, the lower grooves of the lower surface being opposite the upper grooves of the upper surface.

The lower grooves of the lower surface and the upper grooves of the upper surface of a flexible shoe according to the invention correspond to the main articulations of the foot, and the lower grooves of the lower surface and the upper grooves of the upper surface demarcate platforms of the damping sole.

Because of their location, the platforms demarcate stable support zones for the foot. Each platform of the damping sole, demarcated by grooves or groove portions, directly and accurately transmits sensory information, supports, impacts, and other force. Each platform enables anatomical operation of the various articulations of the foot in the sagittal, transverse, and frontal planes during a walking or running cycle. More broadly speaking, it appears that the damping sole generally respects the articular mobility of the foot, as it directly and accurately transmits sensory information, supports, impacts, and other stresses. It can thus be said that the damping sole, and therefore the sole assembly in its entirety, faithfully follows each rolling motion of the foot, because it follows its articulations. The user accurately or faithfully perceives the supports, the impacts and, more generally, the various stresses that occur in the area of the sole assembly. The invention therefore respects the kinematics of the foot articulations, which operate independently of one another due to the specific arrangement of the grooves. The structure of the damping sole enables the bones to move so as to avoid constraint to forward motion, that is to say, to walking or running. This enables the foot to function in a natural manner. This is why the damping sole improves energy efficiency, by respecting the natural biomechanics of the foot and by maintaining a good level of damping. The damping sole does not constrain the foot, enables the mobility of the various articulations of the foot and of the lower limb, while reducing the stresses that are applied thereto.

Other advantages, in addition to those related to a better transmission of sensory information, include a reduction in user fatigue and an improvement to user performance, and a reduction in the risk of injuries, whether in the area of the foot or in the area of knee, as additionally described below. The rolling motion of the foot is more efficient during contact with the ground due to a decrease in the forces applied in the frontal and transverse planes, especially in the area of the hip and of the knee, that is to say, forces that are not directed in the direction of movement of the user.

It can generally be said that the invention provides an improved flexible shoe.

BRIEF DESCRIPTION OF THE DRAWINGS

Other characteristics and advantages of the invention will be better understood from the description that follows, with reference to the annexed drawing figures illustrating a non-limiting embodiment, and in which.

DETAILED DESCRIPTION

The embodiment described below with reference to FIGS. 1 to 4 relates for example to a flexible shoe for walking on firm ground or in snow. However, the invention is applicable to other fields, such as those mentioned above.

Figure 1:
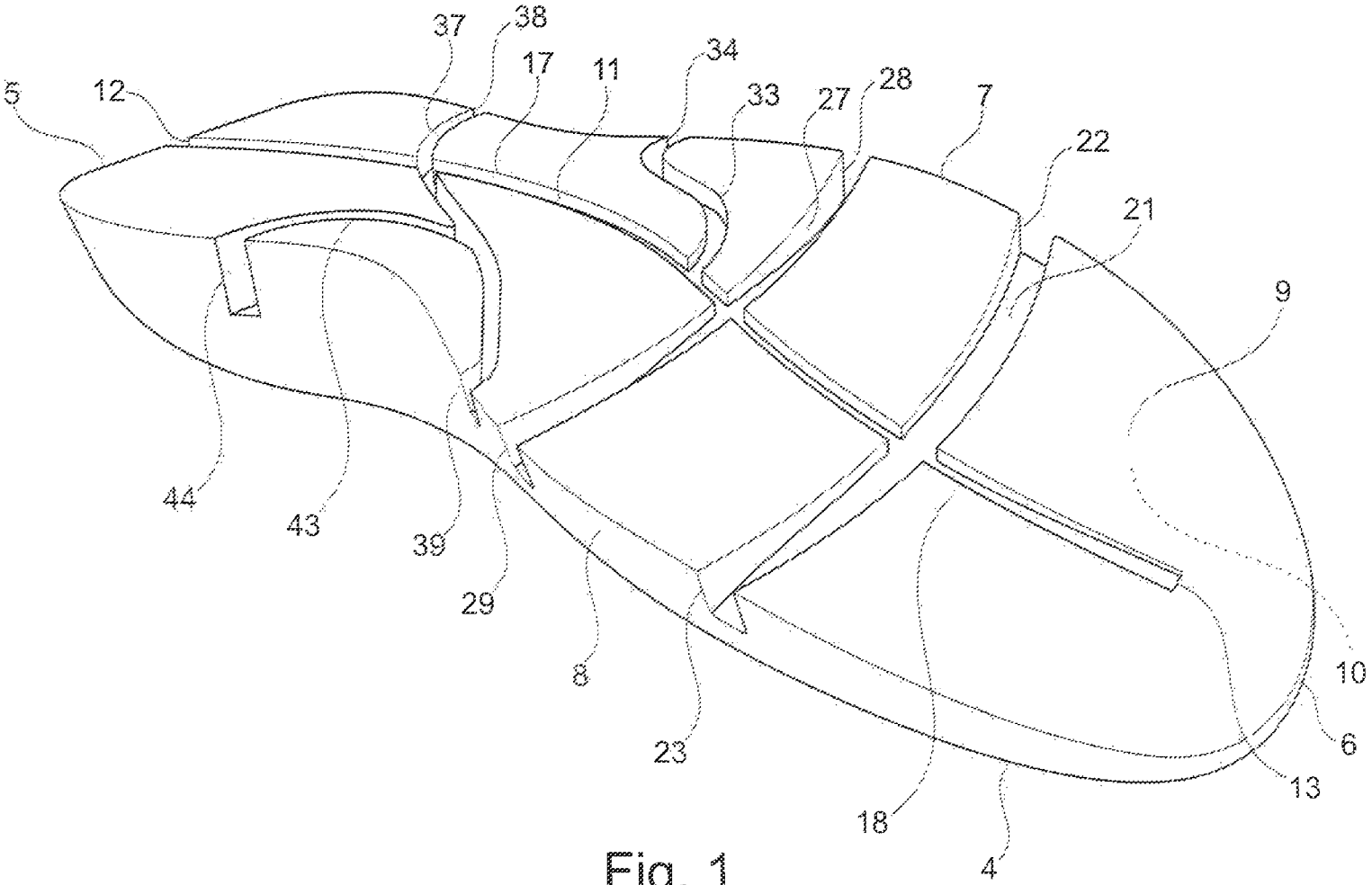
FIG. 1 is a front perspective view showing the bottom of a damping sole, for a flexible shoe according to the embodiment described.

As can be understood with reference to FIGS. 1. to 4, a walking shoe 1 is provided to receive the foot of the user.

The shoe 1 includes an outer sole assembly 2 and an upper 3 affixed to the sole assembly. For reasons of convenience, the upper is shown as a dotted line (see FIG. 4), simply in order not to burden the description. Any upper structure known to one with ordinary skill in the art can be associated with the outer sole assembly 2. The latter comprises a damping sole 4 extending lengthwise, along a longitudinal direction L, from a rear end 5 to a front end 6, widthwise, along a transverse direction W, between a lateral side 7 and a medial side 8, and heightwise, from a lower surface 9 to an upper surface 10.

The surface 9 is referred to as the lower surface because it is intended to contact the ground directly or indirectly. When contact is indirect, a wear layer, for example, not shown, is affixed to the lower surface 9. This is generally a layer of synthetic material, such as rubber or any suitable material, to provide the shoe with properties such as good adhesion to the ground. The wear layer may be made of a single piece, or of several pieces. Alternatively, a plurality of superimposed layers on the side of the lower surface 9, with different mechanical properties, may be provided, The surface 10 is referred to as the upper surface because it is intended to be affixed to the upper 3 directly or indirectly. When the affixing is indirect, a functional layer, for example, not shown, is affixed to the upper surface 10, Similar to the wear layer, the functional layer may be made of a single piece, or of several pieces.

The shoe 1 is structured to enable good rolling motion of the foot during walking (for example, the shoe flexes at a flexion crease, such as at the metatarsophalangeal joint, as the heel is raised and lowered in relation to the toe), transmissions of sensory information, and impulses for supports or jump landings. This is why, the outer sole assembly 2 and the upper 3 are relatively flexible. It will be better understood in the following description that the damping sole 4, notably, is flexible.

With respect more specifically to the structure of the damping sole, the lower surface 9 has lower grooves 11, 21, 27, 33, 37, 43, the upper surface 10 has upper grooves 14, 24, 30, 35, 40 , 45, the lower grooves of the lower surface being opposite the upper grooves of the upper surface. This facilitates reversible deformations of the damping sole, especially in bending.

According to the invention, the lower grooves 11, 21, 27, 33, 37, 43 of the lower surface 9 and the upper grooves 14, 24, 30, 35, 40, 45 of the upper surface 10 correspond to the main articulations of the foot, and the lower grooves of the lower surface 9 and the upper grooves of the upper surface 10 demarcate platforms 48 to 68 of the damping sole 4.

Due to their location, the platforms demarcate stable support zones for the foot. The invention respects the kinematics of the foot articulations, which operate independently of one another due to the specific arrangement of the grooves. The structure of the damping sole enables the bones to move so as to avoid constraint to forward motion, that is to say, to walking. This enables the foot to function in a natural fashion. This is why the damping sole improves energy efficiency, by respecting the natural biomechanics of the foot and by maintaining a good level of damping.

Figure 2:
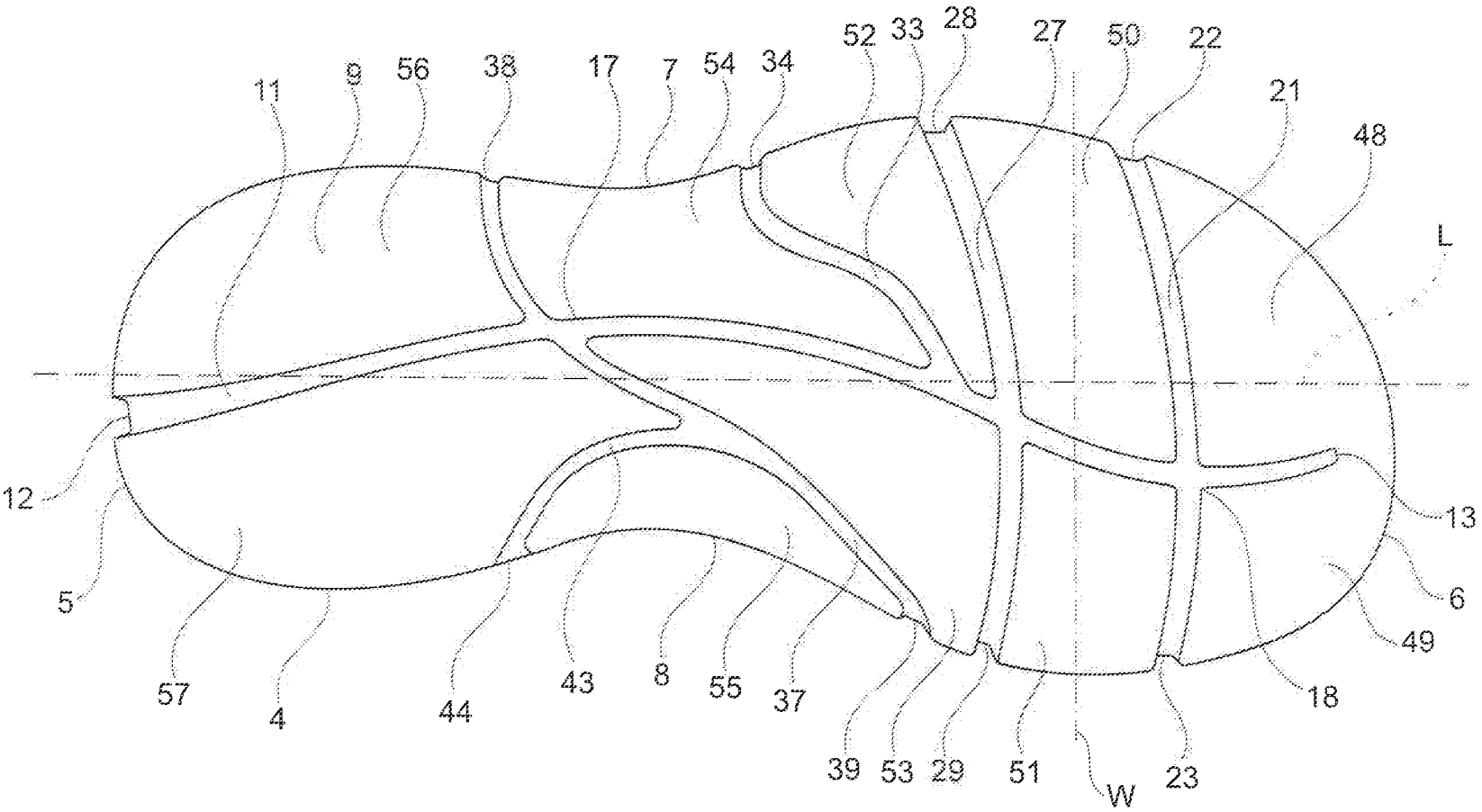
FIG. 2 is a bottom view of the damping sole of FIG. 1.
Figure 3:
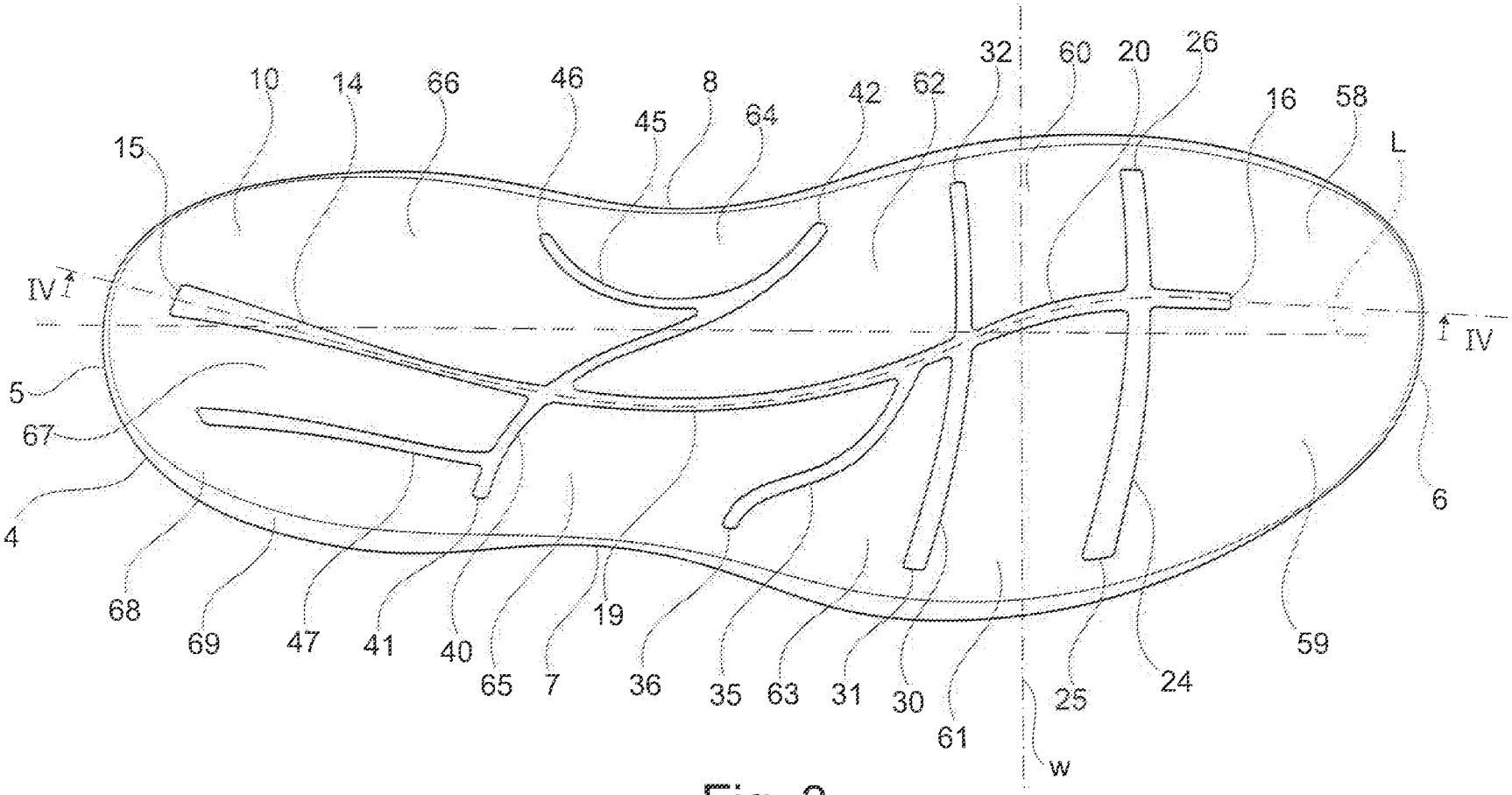
FIG. 3 is a top view of the damping sole of FIG. 1.

With reference more particularly to FIGS. 2 and 3, it can be seen that the lower surface 9 has a lower longitudinal groove 11 extending from a rear limit 12 to a front limit 13, the rear limit 12 being away from the rear end 5 by a distance between 0 and 20% of the length of the damping sole 4, the front limit 13 being away from the front end 6 by a distance between 0 and 20% of the length of the damping sole, that the upper surface 10 has an upper longitudinal groove 14 extending from a rear limit 15 to a front limit 16, the rear limit 15 being away from the rear end 5 by a distance between 0 and 20% of the length of the damping sole, the front limit 16 being away from the front end 6 by a distance between 0 and 20% of the length of the damping sole, the lower longitudinal groove 11 bending over a portion between 80 and 100% of its length, the lower longitudinal groove 11 having a rear inflection point 17 located away from the rear end 5 at a distance between 30 and 60% of the length of the shoe, the lower longitudinal groove 11 having a front inflection point 18 located away from the front end 6 at a distance between 10 and 30% of the length of the shoe, the lower longitudinal groove 11 deviating from the medial side 8 towards the lateral side 7 between the rear limit 12 and the rear inflection point 17, the lower longitudinal groove 11 deviating from the lateral side 7 towards the medial side between the rear inflection point 17 and the front inflection point 18, the lower longitudinal groove 11 deviating from the medial side 8 towards the lateral side 7 between the front inflection point 18 and the front limit 13, the upper longitudinal groove bending over a portion between 80 and 100% of its length, the upper longitudinal groove 14 having a rear inflection point 19 located away from the rear end 5 at a distance between 30 and 60% of the length of the shoe, the upper longitudinal groove 14 having a front inflection point 20 located away from the front end 6 at a distance between 10 and 30% of the length of the shoe, the upper longitudinal groove 14 deviating from the medial side 8 towards the lateral side 7 between the rear limit 15 and the rear inflection point 19, the upper longitudinal groove 14 deviating from the lateral side 7 towards the medial side 8 between the rear inflection point 19 and the front inflection point 20, the upper longitudinal groove 14 deviating from the medial side 8 towards the lateral side 7 between the front inflection point 20 and the front limit 16, the lower longitudinal groove 11 being opposite the upper longitudinal groove 14. The arrangement of the lower 9 and upper 14 longitudinal grooves provides the damping sole 4 with a transverse bending ability, along all or almost all of its length. The transverse bending is more pronounced in the area of the grooves. This enables transfers of transverse supports, that is to say, a switch of supports from the lateral side to the medial side, and vice versa.

FIG. 2. also shows that the lower surface 9 has a first transverse groove 21 extending from a lateral limit 22 to a medial limit 23, between a transverse line located away from the front end 6 by a distance equal to 15% of the length of the shoe and a transverse line located away from the front end 6 by a distance equal to 30% of the length of the shoe, that the upper surface 10 has a first transverse groove 24 extending from a lateral limit 25 to a medial limit 26, between a transverse line located away from the front end 6 by a distance equal to 15% of the length of the shoe and a transverse line located away from the front end 6 by a distance equal to 30% of the length of the shoe, and that the first transverse groove 21 of the lower surface 9 is opposite the first transverse groove 24 of the upper surface 10. The first transverse grooves 21, 24 are in fact located in a zone that corresponds to the toe articulations. This facilitates the rolling motion of the forefoot.

FIG. 2 also shows that the lower surface 9 has a second transverse groove 27 extending from a lateral limit 28 to a medial limit 29, between a transverse line located away from the front end 6 by a distance equal to 30% of the length of the shoe and a transverse line located away from the front end 6 by a distance equal to 45% of the length of the shoe, that the upper surface 10 has a second transverse groove 30 extending from a lateral limit 31 to a medial limit 32, between a transverse line located away from the front end 6 by a distance equal to 30% of the length of the shoe and a transverse line located away from the front end 6 by a distance equal to 45% of the length of the boot, and that the second transverse groove 27 of the lower surface 9 is opposite the second transverse groove 30 of the upper surface 10. The second transverse grooves 27, 30 are actually located in a zone that corresponds to the articulations between the metatarsus and the toes. This also facilitates the rolling motion of the forefoot.

FIG. 2 further shows that the lower surface 9 has a first oblique groove 33 extending from a lateral limit 34 to the longitudinal groove 11 between a transverse line located away from the front end 6 by a distance equal to 35% of the length of the shoe and a transverse line located away from the front end 6 by a distance equal to 60% of the length of the shoe, that the upper surface 10 has a first oblique groove 35 extending from a lateral limit 36 to the longitudinal groove 14, between a transverse line located away from the front end 6 by a distance equal to 35% of the length of the shoe and a transverse line located away from the front end 6 by a distance equal to 60% of the length of the shoe, and that the first oblique groove 33 of the lower surface 9 is opposite the first oblique groove 35 of the upper surface 10. The first oblique grooves 33, 35 are in fact located in a lateral zone of articulation between the metatarsus and the cuboid. This facilitates the rolling motion of the foot on the lateral side.

FIG. 2 still further shows that the lower surface 9 has a second oblique groove 37 extending from a lateral limit 38 to a medial limit 39, between a transverse line located away from the front end 6 by a first distance equal to 35% of the length of the shoe and a transverse line located away from the front end 6 by a second distance equal to 75% of the length of the shoe, that the upper surface 10 has a second oblique groove 40 extending from a lateral limit 41 to a medial limit 42, between a transverse line located away from the front end 6 by a third distance equal to 35% of the length of the shoe and a transverse line located away from the front end 6 by a fourth distance equal to 75% of the length of the shoe, and that the second oblique groove 37 of the lower surface 9 is opposite the second oblique groove 40 of the upper surface 10. The second oblique grooves 37, 40 are in fact located in a zone of articulation between the calcaneus and the metatarsus. This facilitates the deformations of the foot in the area of the metatarsus.

FIG. 2 still further shows that the lower surface 9 has a third oblique groove 43 extending from a medial limit 44 to the second oblique groove 37, between a transverse line located away from the front end 6 by a fifth distance equal to 50% of the length of the shoe and a transverse line located away from the front end 6 by a sixth distance equal to 75% of the length of the shoe, that the upper surface 10 has a third oblique groove 45 extending from a medial limit 46 to the second oblique groove 40, between a transverse line located away from the front end 6 by a seventh distance equal to 50% of the length of the shoe and a transverse line located away from the front end 6 by an eighth distance equal to 75% of the length of the shoe, and that the third oblique groove 43 of the lower surface 9 is opposite the third oblique groove 45 of the upper surface 10. The third oblique grooves 43, 45 are in fact located in the zone of the arch of the foot. This facilitates the deformations of the foot in the area of its arch.

FIG. 3 shows that the upper surface 10 has an additional longitudinal groove 47, located between the lateral side 7 and the longitudinal groove 14, and extending between the rear end 5 and the second oblique groove 40. The longitudinal groove 47 is actually located in a heel zone of the foot. This helps the heel of the foot to be wedged transversely.

FIGS. 2 and 3 also show that the lower surface 9 of the damping sole 4 has ten platforms 48 to 57, and that the upper surface 10 of the damping sole 4 has eleven. platforms 58 to 68. These platforms are the divisions of the damping sole 4 that are demarcated by the grooves. The platforms enable the foot to find respective stable supports locally, especially during a rolling motion of the shoe.

Particular attention is directed to platforms 53, 54, and 55 of the lower surface 9 of the damping sole 4, as shown in FIG. 2. Platform 55, which can be referred to as a first platform, is located in an area corresponding to the arch of the wearer, and it is demarcated at least in part by the third oblique groove 43 of the lower surface and a portion of the medial side 8 of the damping sole 4 extending between first and second medial limits 44 and 39. As also shown in FIG. 2, the third oblique groove has a concavity facing the medial side of the damping sole. Platform 53, which can be referred to as a second platform, is demarcated at least in part by the second oblique groove 37 of the lower surface 9, a portion of the lower longitudinal groove 11, and the second transverse groove 27. Platform 54, which can be referred to as a third platform, is demarcated at least in part by the second oblique groove 37 of the lower surface 9, a portion of the lower longitudinal groove 11 and a portion of the lateral side 7 of the damping sole. As also shown in FIG. 2, the lower portion of the longitudinal groove has a concavity facing the medial side of the damping sole.

It can be noticed in FIG. 2, that the third oblique groove 43 partially demarcating the platform 55 has a concavity facing the medial side 8 of the damping sole 4, and that the portion of the lower longitudinal groove 11 partially demarcating the platform 53 also has a concavity facing the medial side 8 of the damping sole.

Figure 4:
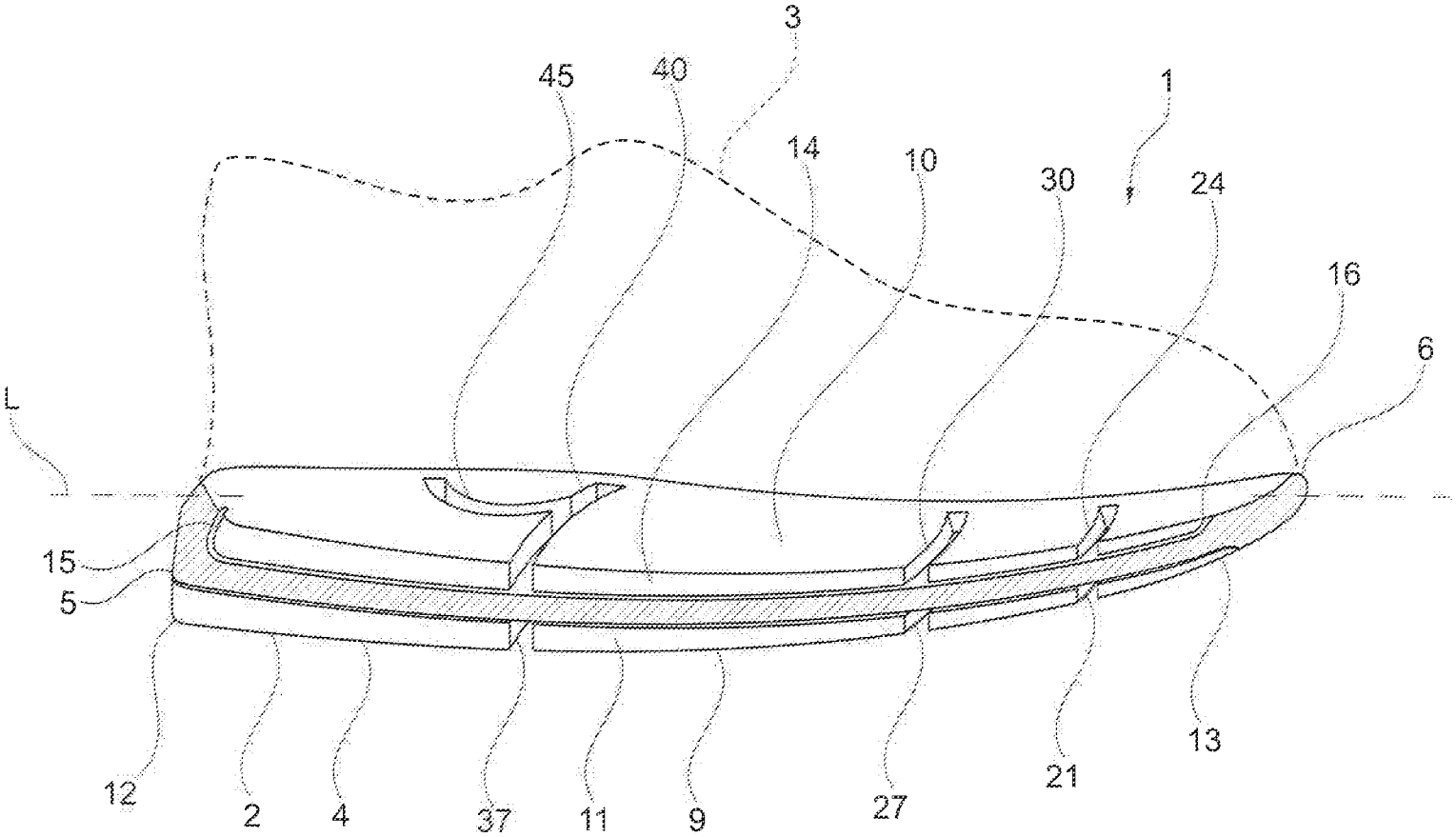
FIG. 4 is a cross section along the line IV-IV of FIG. 3, to which a schematic representation of the shoe upper appears.

Considering especially FIG. 4, it can be seen that the thickness of the damping sole 4, measured half-way between the lateral side 7 and the medial side 8, is between 1.0 and 8.0 mm towards the front end 6 and between 5.0 and 25 mm towards the rear end 5, and that the thickness of the damping sole 4 increases from the front end 6 to the rear end 5. This is to ensure that the heel of the foot is slightly raised in relation to the forefoot. This substantially or completely prevents injuries in the area of the Achilles tendon.

FIG. 4 also shows that the depth of the grooves 11, 14, 21, 24, 27, 30, 33, 35, 37, 40, 43, 45, 47 of the damping sole 4 increases from the front end 6 to the rear end 5. This preserves the ability of the damping sole 4 to flex in the area in which it is thicker, i.e., towards the rear.

It can still further be seen that the lower surfaces of the lower platforms 48 to 57 are contained in an even lower envelope surface, and that the upper surfaces of the upper platforms 58 to 68 are contained in an even upper envelope surface. This is to make the foot rolling motion as even as possible during a walking cycle.

In addition, the damping sole 4 comprises an upper peripheral lip 69. This makes it easier to affix the upper 3 and the damping sole 4 to one another by gluing.

Finally, it can be seen, in a non-limiting fashion, that the damping sole 4 is a unitary element. This renders manufacturing simpler and faster. However, the damping sole may alternatively be provided to comprise a plurality of portions affixed to one another. These portions can all be made of the same material or, alternatively, various materials can be used to make various portions.

In any case, the invention is made from materials and according to implementation techniques known to one with ordinary skill in the art.

The invention is not limited to the embodiment described above, and includes all the technical equivalents that fall within the scope of the claims that follow.

In particular, various curvatures can be provided for making the grooves.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

The invention claimed is:

1. Flexible shoe comprising:

an outer sole assembly; and an upper;

the outer sole assembly comprising a damping sole;

the damping sole extending:

lengthwise from a rear end to a front end;

widthwise between a lateral side and a medial side; and heightwise from a lower surface to an upper surface;

the lower surface of the damping sole having lower grooves;

the upper surface having upper grooves;

the lower grooves of the lower surface being opposite the upper grooves of the upper surface;

the lower surface having a lower longitudinal groove extending from a rear limit to a front limit and spaced between the lateral side and the medial side; and the lower grooves of the lower surface and the upper grooves of the upper surface demarcate a plurality of platforms of the damping sole;

the lower surface has a second oblique groove extending from a lateral limit to a first medial limit, between a transverse line located away from the front end by a first distance and a transverse line located away from the front end by a second distance greater than the first distance;

the upper surface has a second oblique groove extending from a lateral limit to a medial limit, between a transverse line located away from the front end by a third distance and a transverse line located away from the front end by a fourth distance greater than the third distance;

the second oblique groove of the lower surface is opposite the second oblique groove of the upper surface;

the lower surface has a third oblique groove extending from a second medial limit to the second oblique groove, between a transverse line located away from the front end by a fifth distance and a transverse line located away from the front end by a sixth distance greater than the fifth distance;

the upper surface has a third oblique groove extending from a medial limit to the second oblique groove, between a transverse line located away from the front end by a seventh distance and a transverse line located away from the front end an eighth distance greater than the seventh distance; and the third oblique groove of the lower surface is opposite the third oblique groove of the upper surface;

said plurality of platforms comprising:

a first platform demarcated at least in part by the third oblique groove of the lower surface and a portion of the medial side of the damping sole extending from the second medial limit of the lower surface to the first medial limit of the lower surface;

a second platform demarcated at least in part by the second oblique groove of the lower surface, a portion of the lower longitudinal groove, and a transverse groove; and a third platform demarcated at least in part by the second oblique groove of the lower surface, a portion of the lower longitudinal groove, and a portion of the lateral side of the damping sole.

2. Shoe according to claim 1, wherein:

the rear limit of the lower longitudinal groove is away from the rear end by a distance from 0 to 20% of the length of the damping sole, and the front limit is away from the front end by a distance from 0 to 20% of the length of the damping sole;

the upper surface has an upper longitudinal groove extending from a rear limit to a front limit, the rear limit being away from the rear end by a distance from 0 to 20% of the length of the damping sole, the front limit being away from the front end by a distance from 0 to 20% of the length of the damping sole;

the lower longitudinal groove bends over a portion from 80 to 100% of its length, the lower longitudinal groove having a rear inflection point located away from the rear end at a distance from 30 to 60% of the length of the shoe, the lower longitudinal groove having a front inflection point located away from the front end at a distance from 10 to 30% of the length of the shoe;

the lower longitudinal groove deviates from the medial side towards the lateral side between the rear limit and the rear inflection point;

the lower longitudinal groove deviates from the lateral side towards the medial side between the rear inflection point and the front inflection point;

the lower longitudinal groove deviates from the medial side towards the lateral side between the front inflection point and the front limit;

the upper longitudinal groove bends over a portion from 80 to 100% of its length, the upper longitudinal groove having a rear inflection point located away from the rear end at a distance from 30 to 60% of the length of the shoe, the upper longitudinal groove having a front inflection point located away from the front end at a distance from 10 to 0% of the length of the shoe;

the upper longitudinal groove deviates from the medial side towards the lateral side between the rear limit and the rear inflection point;

the upper longitudinal groove deviates from the lateral side towards the medial side between the rear inflection point and the front inflection point;

the upper longitudinal groove deviates from the medial side towards the lateral side between the front inflection point and the front limit; and the lower longitudinal groove is opposite the upper longitudinal groove.

3. Shoe according to claim 1, wherein:

one of the grooves of the lower surface is a first transverse groove extending from a lateral limit to a medial limit, between a transverse line located away from the front end by a distance equal to 15% of the length of the shoe and a transverse line located away from the front end by a distance equal to 30% of the length of the shoe;

one of the grooves of the upper surface is a first transverse groove extending from a lateral limit to a medial limit, between a transverse line located away from the front end by a distance equal to 15% of the length of the shoe and a transverse line located away from the front end by a distance equal to 30% of the length of the shoe; and the first transverse groove of the lower surface is opposite the first transverse groove of the upper surface.

4. Shoe according to claim 1, wherein:

one of the grooves of the lower surface is a second transverse groove extending from a lateral limit to a medial limit, between a transverse line located away from the front end by a distance equal to 30% of the length of the shoe and a transverse line located away from the front end by a distance equal to 45% of the length of the shoe;

one of the grooves of the upper surface is a second transverse groove extending from a lateral limit to a medial limit, between a transverse line located away from the front end by a distance equal to 30% of the length of the shoe and a transverse line located away from the front end by a distance equal to 45% of the length of the shoe; and the second transverse groove of the lower surface is opposite the second transverse groove of the upper surface.

5. Shoe according to claim 1, wherein:

one of the grooves of the lower surface is a first oblique groove extending from a lateral limit to the longitudinal groove, between a transverse line located away from the front end by a distance equal to 35% of the length of the shoe and a transverse line located away from the front end by a distance equal to 60% of the length of the shoe;

one of the grooves of the upper surface is a first oblique groove extending from a lateral limit to the longitudinal groove, between a transverse line located away from the front end by a distance equal to 35% of the length of the shoe and a transverse line located away from the front end by a distance equal to 60% of the length of the shoe; and the first oblique groove of the lower surface is opposite the first oblique groove of the upper surface.

6. Shoe according to claim 1, wherein:

one of the grooves of the upper surface is an additional longitudinal groove, located between the lateral side and the longitudinal groove, and extending between the rear end and the second oblique groove.

7. Shoe according to claim 6, wherein:

the lower surface of the damping sole has ten platforms; and the upper surface of the damping sole has eleven platforms.

8. Shoe according to claim 1, wherein:

a thickness of the damping sole increases between 1.0 mm to 25 mm from the front end to the rear end.

9. Shoe according to claim 1, wherein:

a depth of a plurality of upper and lower grooves of the damping sole increases from the front end towards the rear end.

10. Shoe according to claim 1, wherein:

lower surfaces of the lower platforms are contained in a lower envelope surface.

11. Shoe according to claim 1, wherein:

upper surfaces of the upper platforms are contained in an upper envelope surface.

12. Shoe according to claim 1, wherein:

the damping sole comprises an upper peripheral lip.

13. Shoe according to claim 1, wherein:

the damping sole is a unitary element.

14. Shoe according to claim 1, wherein:

each of the outer sole and the upper has a flexible structure allowing the shoe to flex during use at a flexion crease of the shoe.

15. Shoe according to claim 1, wherein:

the first distance is equal to 35% of the length of the shoe;

the second distance is equal to 75% of the length of the shoe;

the third distance is equal to 35% of the length of the shoe;

the fourth distance is equal to 75% of the length of the shoe;

the fifth distance is a equal to 50% of the length of the shoe;

the sixth distance is equal to 75% of the length of the shoe;

the seventh distance is equal to 50% of the length of the shoe; and the eighth distance is equal to 75% of the length of the shoe.

16. Shoe according to claim 1, wherein:

the first platform is configured to be located in an area of an arch of the wearer's foot.

17. Shoe according to claim 16, wherein:

the lower surface has a second transverse groove extending from a lateral limit to a medial limit configured to be located in an area of a metatarsus of the wearer's foot; and the third platform is further demarcated by the second transverse groove.

18. Shoe according to claim 1, wherein:

the lower surface has a second transverse groove extending from a lateral limit to a medial limit configured to be located in an area of a metatarsus of the wearer's foot; and the third platform is further demarcated by the second transverse groove.

19. Shoe according to claim 1, wherein:

the first oblique groove of the lower surface is located in a lateral zone and is configured to extend along an articulation between the wearer's metatarsus and cuboid;

the second oblique groove of the lower surface is configured to extend along an articulation between the wearer's calcaneus and metatarsus; and the third oblique groove of the lower surface is configured to extend along an articulation facilitating deformation of the wearer's foot in area of the wearer's arch in a medial zone of the wearer's foot.

20. Shoe according to claim 1, wherein:

the third oblique groove partially demarcating the first platform has a concavity facing the medial side of the damping sole; and the portion of the lower longitudinal groove partially demarcating the third platform has a concavity facing the medial side of the damping sole.

* * * * *